US005856833A

United States Patent [19]

Elgee et al.

[11] Patent Number: 5,856,833

[45] Date of Patent: Jan. 5, 1999

[54] OPTICAL SENSOR FOR INK JET PRINTING SYSTEM

[75] Inventors: Steven B. Elgee, Portland, Oreg.; John D. Lytle, Santa Cruz, Calif.

[73] Assignee: Hewlett-Packard Company, Palo Alto, Calif.

[21] Appl. No.: 944,597

[22] Filed: Oct. 6, 1997

Related U.S. Application Data

[63] Continuation of Ser. No. 770,534, Dec. 18, 1996.

[51] Int. Cl.[6] ..... B41J 29/393

[52] U.S. Cl. ..... 347/19; 250/216; 250/234

[58] Field of Search ..... 347/19; 250/216, 250/234, 235, 236, 250; 359/198

[56] References Cited

U.S. PATENT DOCUMENTS

| | | | |
|---|---|---|---|
| 4,414,476 | 11/1983 | Maddox et al. | 250/235 |
| 4,916,638 | 4/1990 | Haselby et al. | 364/519 |
| 4,922,270 | 5/1990 | Cobbs et al. | 364/140 R |
| 5,109,239 | 4/1992 | Cobbs et al. | 346/140 R |
| 5,130,531 | 7/1992 | Ito et al. | 250/216 |
| 5,132,833 | 7/1992 | Diau | 359/211 |
| 5,187,360 | 2/1993 | Pasco | 250/208.2 |
| 5,250,956 | 10/1993 | Haselby et al. | 346/1.1 |
| 5,283,681 | 2/1994 | Hoshino et al. | 359/198 |
| 5,289,208 | 2/1994 | Haselby | 346/140 R |
| 5,297,017 | 3/1994 | Haselby et al. | 346/1.1 |
| 5,387,976 | 2/1995 | Lesniak | 356/379 |
| 5,404,020 | 4/1995 | Cobbs | 250/548 |
| 5,448,269 | 9/1995 | Beauchamp et al. | 347/19 |
| 5,451,990 | 9/1995 | Sorenson et al. | 347/37 |
| 5,606,449 | 2/1997 | Nishiyama | 359/210 |
| 5,633,744 | 5/1997 | Nakajima | 359/196 |

FOREIGN PATENT DOCUMENTS

| | | |
|---|---|---|
| 0622236A | 11/1994 | European Pat. Off. . |
| 0663296A | 7/1995 | European Pat. Off. . |

OTHER PUBLICATIONS

Search Report from PCT/US97/23352, 2 pages, dated May 13, 1998.

"Diffractive Optics Move Into The Commercial Arena," Laser Focus World Magazine, Oct. 1994.

"Diffractive Optics Improve Product Design," Photonics Spectra Magazine, Sep. 1995.

*Primary Examiner*—Edgar Burr
*Assistant Examiner*—Dave A. Ghatt

[57] ABSTRACT

An optical sensor module for identifying characteristics of printed ink jet images on printing media residing in a media plane. The module has a chassis and a connected illumination source and detector spaced apart from the media plane. An integral optical element is positioned between the image plane and the illumination source and detector. The optical element has a first portion having a first optical characteristic positioned on a first optical path between the illumination source and a selected region of the media plane, and a second portion having a second optical characteristic different from the first optical characteristic and positioned on a second optical path between the illumination source and the selected region. The optical element may include diffractive optics, fresnel lenses, and conventional lenses formed of transparent plastics to steer, focus and diffuse light onto the selected region and return it efficiently to the detector.

21 Claims, 4 Drawing Sheets

OPTICAL SENSOR FOR INK JET PRINTING SYSTEM

REFERENCE TO RELATED APPLICATION

This is a continuing application based on U.S. Pat. application Ser. No. 08/770,534, filed on Dec. 18, 1996.

FIELD OF THE INVENTION

This invention related to printing systems, and more particularly to ink jet printers and plotters having multiple pens for multi-color operation

BACKGROUND AND SUMMARY OF THE INVENTION

A typical ink jet printer, plotter, or other printing system has a pen that reciprocates over a printable surface such as a sheet of paper. The pen includes a print head having an array of numerous orifices through which droplets of ink may be expelled into the surface to generate a desired pattern. Color ink jet printers typically employ four print heads, each connected to an ink supply containing a different color of ink (e.g. black, cyan, yellow, and magenta.) The different print heads may be included on separate, replaceable ink pens. A full color image may be printed by sequentially printing overlapping patterns with each of the different color inks. For good printed output, the different color images must be in precise registration.

In existing printers, registration of the different colors may be achieved by printing an alignment pattern with each color, then optically sensing the positions of the printed patterns and determining the amounts of any deviations from nominal positions. The printer electronically adjusts the firing position for each color so that the resulting output is registered. This is particularly critical for plotters printing on large media sheets, in which small errors may accumulate to provide unacceptable output.

To sense the position of the alignment patterns, an existing printer uses an optical module mounted to the reciprocating print head. The module has a light emitting diode (LED) illuminating a selected region of the media sheet. The light from the illuminated region is focused by a lens onto a photodetector. As the module scans across the sheet over a printed bar pattern, the photodetector records a momentary reduction in collected light flux. The printer electronics calculate the location of the printed pattern, by comparing with an electronic signal from a motion encoder that records the position of the carriage relative to the printer.

A first disadvantage of existing photosensor modules is size. The arrangement of illuminator and detector creates a bulky package, as the detector and lens must be on an axial optical path normal to the selected region, and the light source is thus offset at an angle from the optical path, providing illumination obliquely. As the illuminator is at some distance from the selected region, its remote extremities are undesirably widely spaced apart from the photodetector, creating a bulky package, which is particularly problematic for a carriage mounted component; clearance must be provided along the entire carriage path. If the module is added to the ink jet pen to increase the width of the carriage along the carriage scan axis, the entire printer width must be increased by two times the width increase to permit sensing and printing to the extreme edges of the paper. Such printer size increases are contrary to the normal goal of minimizing desktop printer housing sizes.

A second disadvantage of existing photosensor modules concerns the tradeoff between uniformity of illumination and intensity of illumination. Uniform illumination of the selected region is needed to prevent variations as being interpreted as positional errors. To improve uniformity the LED may be positioned at a greater distance, and its light transmitted through the bore of a white tube. However, the scattering of unfocused light may illuminate a larger area than required, wasting light flux. To obtain useful contrast levels for accurate measurements, a higher intensity of illumination is required to compensate for the lost light, increasing component costs and power consumption. Sharply focusing the LED's light onto the selected region achieves efficiency, but has unacceptable uniformity.

The present invention overcomes or reduces the disadvantages of the prior art by providing an optical sensor module for identifying characteristics of printed ink jet images on printing media residing in a media plane. The module has a chassis and a connected illumination source and detector spaced apart from the media plane. An integral single cluster optical element is positioned between the image plane and the illumination source and detector. The optical element has a first portion having a first optical characteristic positioned on a first optical path between the illumination source and a selected region of the media plane, and a second portion having a second optical characteristic different from the first optical characteristic and positioned on a second optical path between the illumination source and the selected region. The optical element may include diffractive optics, fresnel lenses, and conventional lenses formed of transparent plastics to steer, focus and diffuse light onto the selected region and return it efficiently to the detector.

DETAILED DESCRIPTION OF A PREFERRED EMBODIMENT

Figure 1:
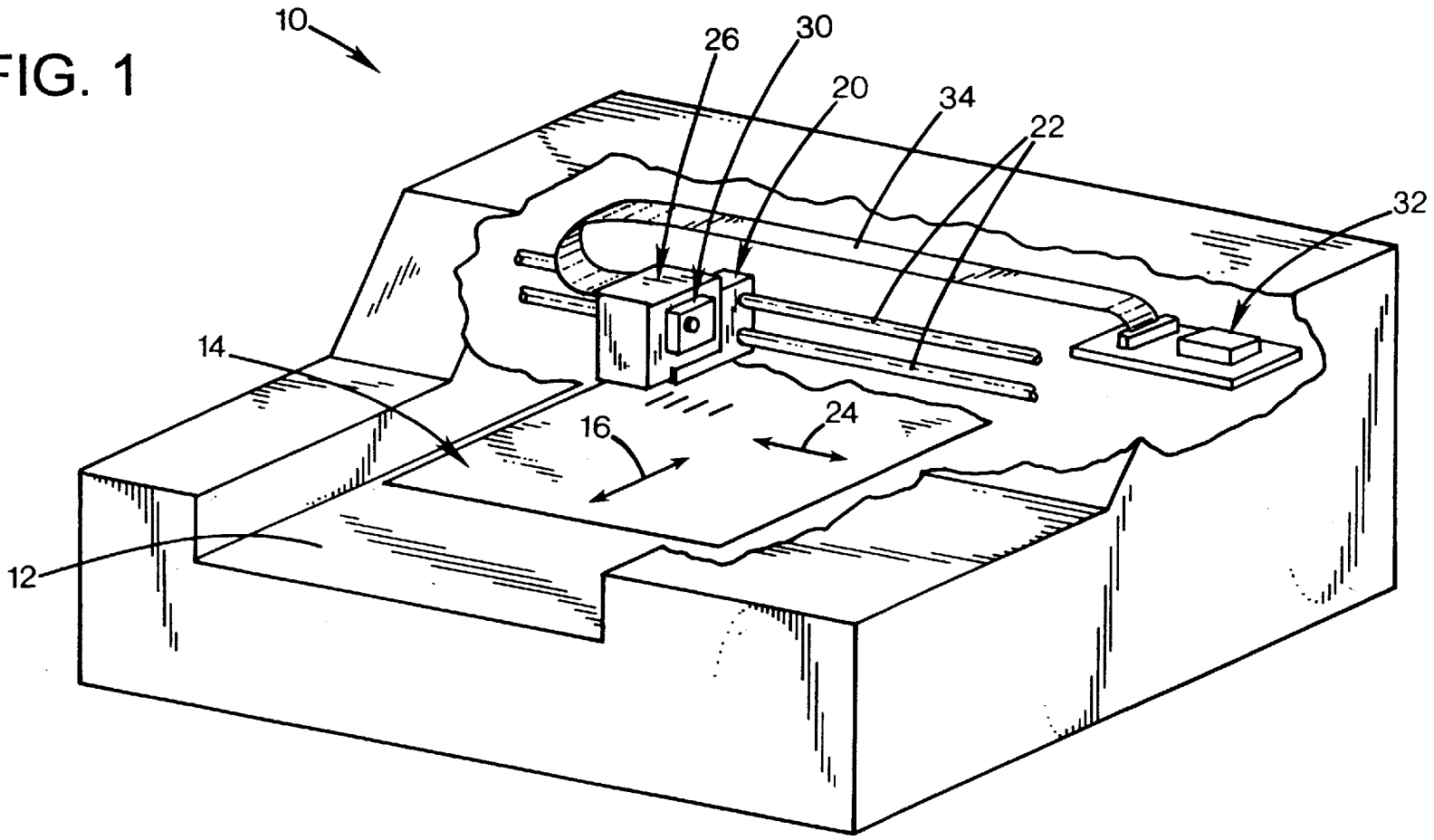
FIG. 1 is a perspective view of a printer according to a preferred embodiment of the invention.

FIG. 1 shows an ink jet printer 10 having a paper platen carrying a sheet of printer media 14 in a media plane 12. A feed mechanism (not shown) has rollers that grip the sheet to move the sheet along a feed axis 16. A carriage 20 mounted to frame rails 22 reciprocates along a scan axis 24 perpendicular to the feed axis, just above the media plane. The carriage supports an ink jet pen 26 and an optical sensor module 30. Both the pen and the sensor module are electrically connected to a printer control circuit 32 via a flexible ribbon cable 34.

Figure 2:
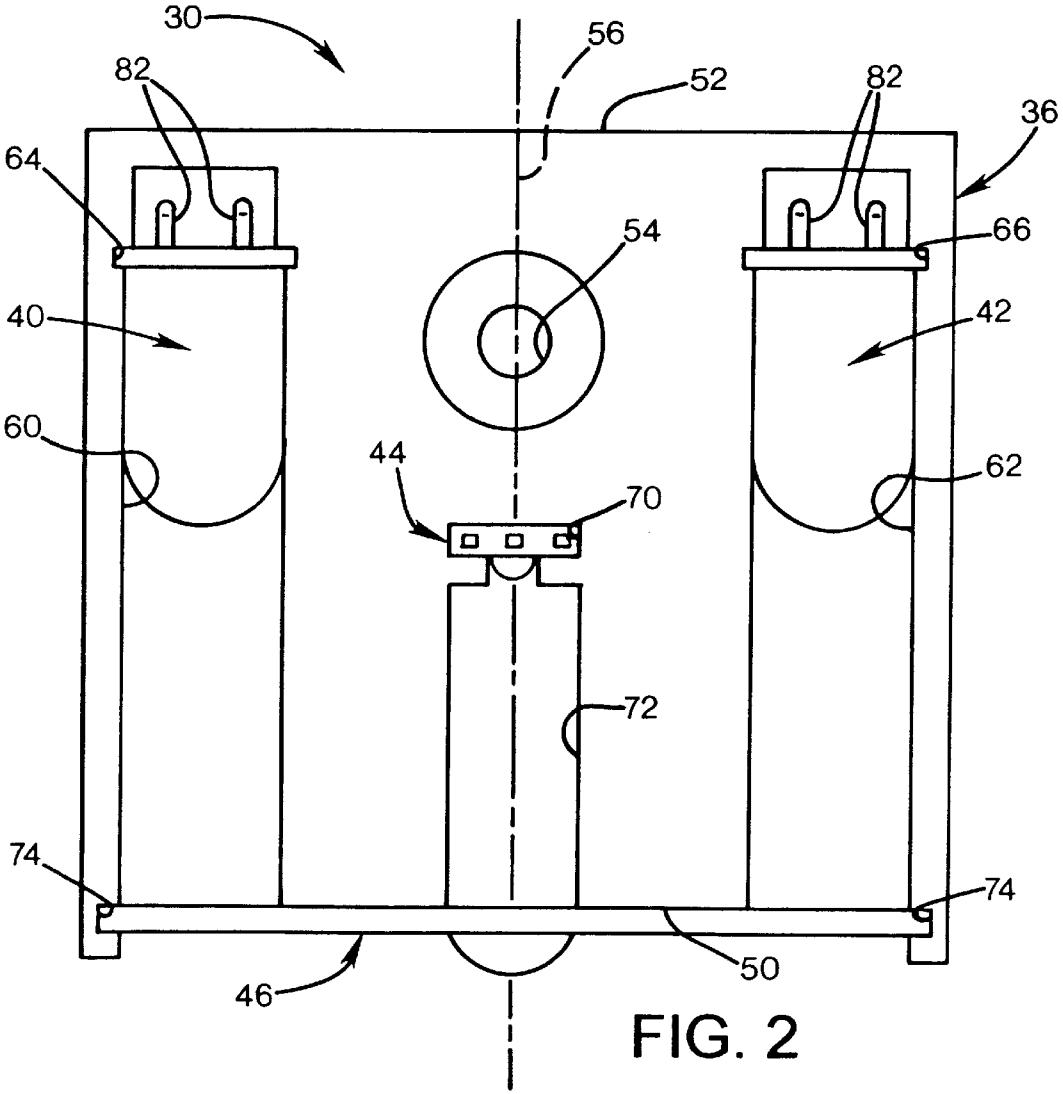
FIG. 2 is an enlarged side view of a sensor module from the printer of FIG. 1.

As shown in FIG. 2, the optical sensor module 30 includes an injection molded rigid plastic chassis 36 having a flat rectangular shape, with a pair of light emitting diode (LED) lamps 40, 42, a photodetector 44, and a molded lens element or cluster 46 mounted to the chassis. The chassis has a lower edge 50 facing downward to the media plane, and an opposed upper edge 52. Near the upper edge, the chassis defines a stepped bore 54 positioned on a vertical axis 56 of the chassis. The bore provides a mounting hole for a screw to secure the chassis to the carriage.

The chassis defines a pair of symmetrical LED-receiving channels 60, 62, each having a width sized to closely receive the body of each of the LEDs 40, 42. The channels serve to prevent crosstalk that would occur if light strayed out of the intended path. The chassis defines a groove 64, 66 near the upper ends of the channels to receive the flanges of each of the lamps to provide secure positional alignment. Alternatively, an interference fit may secure lamps without flanges. The channels extend vertically downward, so that light from the lamps may project unimpeded to the lower face of the chassis. A detector-receiving pocket 70 closely receives the photodetector 44 near the center of the chassis, and a passage 72 extends downward along the vertical axis to provide a light path to the detector.

At the lower face 50 of the chassis 36, a slot or rabbet 74 receives the minor edges of the planar, rectangular lens 46, which encloses the lower ends of the channels 60, 62 and passage 72.

Figure 3:
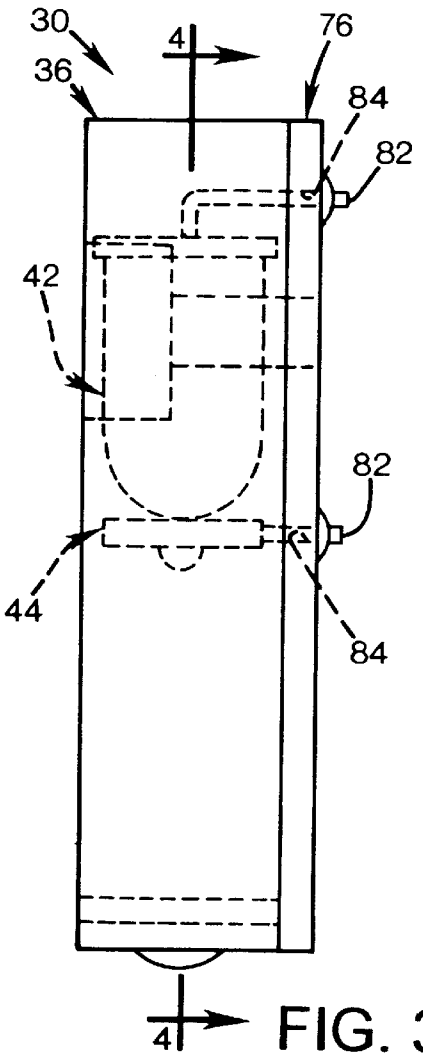
FIG. 3 is an enlarged edge view of the module of FIG. 1.

As shown in FIG. 3, a printed circuit board 76 is attached to a major face of the chassis 36. Plastic connectors (not shown) are mounted to the board and are engaged by holes (not shown) in the chassis. The LEDs 40, 42 and detector 44 include extending electrical leads 82 that pass through metallized through-holes 84 in the board and are soldered therein for mechanical and electrical contact. By using a precisely injected molded plastic chassis, the LED lamps, detector, and lens may be positioned in extremely accurate relative alignment and orientation.

Figure 4:
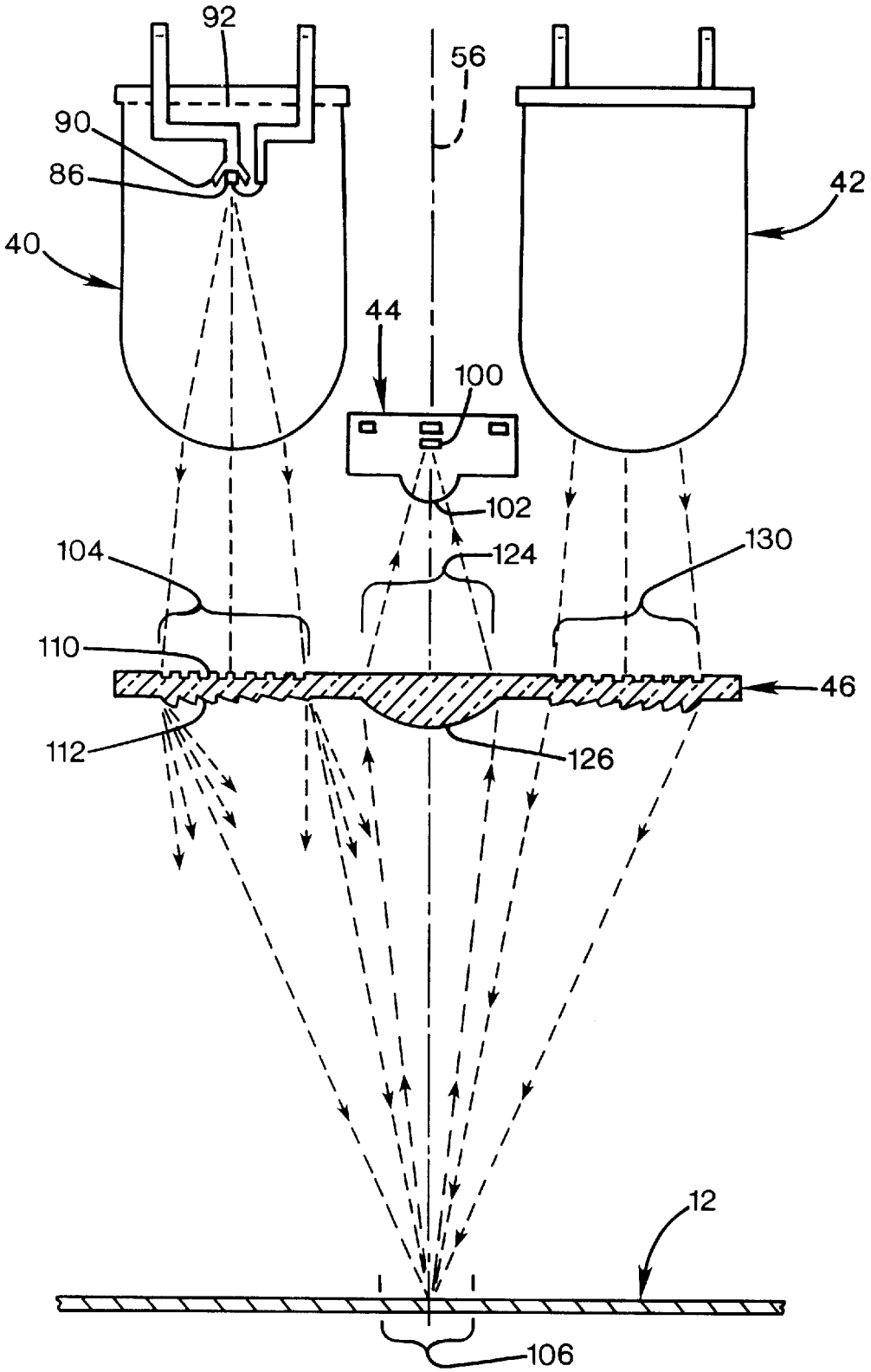
FIG. 4 is an enlarged sectional view of the module of FIG. 2 along line 4-4 of FIG. 3.

FIG. 4 shows the optical components of the system. Each LED lamp 40, 42 includes a die 86 mounted within a reflector cup 90 of a lead frame 92. The die and part of the lead frame are encapsulated in a curved dome 94 of epoxy resin. The dome collects light from the die and reflector cup, and refracts it toward the cluster optical part 46, simultaneously decreasing the divergence angle of the ray bundle 96 impinging on the illumination portion 104, as discussed below. An alternative photocell may have a flat window without a lens, and a sufficient receptor area to gather light flux efficiently, preferably using lens 126 to provide a smaller focused spot.

The molded lens cluster 46 consists of three distinct portions. Portions 104 and 130 serve to condition and direct illumination energy. If need be, portions 104 and 130 could be designed with slightly different parameters, making it possible to tailor operation for two different LEDs emitting radiation in different portions of the optical spectrum. Portion 124 serves to collect radiation scattered from area 106, imaging it upon detector 100. Molding these three separate portions as an integrated part assures control of alignment and positioning variables, maximizing total performance.

The lens cluster 46 includes a first portion area 104 positioned below the first LED lamp 40 whose function is to intercept the beam 96, at the same time deflecting, focusing, and diffusing it to create an illumination spot covering the examination region 106 in the media plane 12. The first portion of lens cluster 46 includes a diffractive structure 110 molded integrally with the upper surface. This structure serves to partially converge the beam 96, and to diffuse it in such a way that the structure of die 86 and cup 90 will not be recognizably imaged at the media plane 12. The same diffractive structure also serves to deviate the beam 96 toward the intersection of the media plane 12 and the axis of symmetry 56, where the information to be examined 106 is located.

The lower portion of area 104 consists of a Fresnel structure 112 whose optical axis coincides with the axis of imaging portion 126 of the molded lens cluster. This Fresnel structure has as its axis of symmetry the optical axis 56 of the imaging portion 126. Both areas 104 and 130 consist of off-axis segments of this Fresnel structure. Thus, the prismatic aspect of the Fresnel lens section serves to complete the task of deviating the beam 96 toward the examination region 106. Theoretically, the upper portion of area 104 could perform this function alone. But sharing the deviation duties between upper and lower surfaces makes possible greater efficiency, minimizing losses due to unavoidable structural limitations in the diffractive and Fresnel surfaces.

The diffractive lens has a multitude of closely spaced ridges that are spaced to provide an interference effect so that a given beam passing through a given portion is efficiently steered to a selected direction. By steering different portions of a beam by different amounts, the differential steering may have the effect of focusing. By introducing a selected slight angular offset in random or selected directions, a focused image may be slightly jumbled or scrambled without significant loss of efficiency. A conventional diffuser would scatter light beyond the selected region, sacrificing efficiency, and simply projecting a defocused image with a conventional lens would not eliminate the non uniformities caused by imaging the LED die and reflector cup, unless the defocusing were so significant as to spread the illumination well beyond the selected region.

Figure 5:
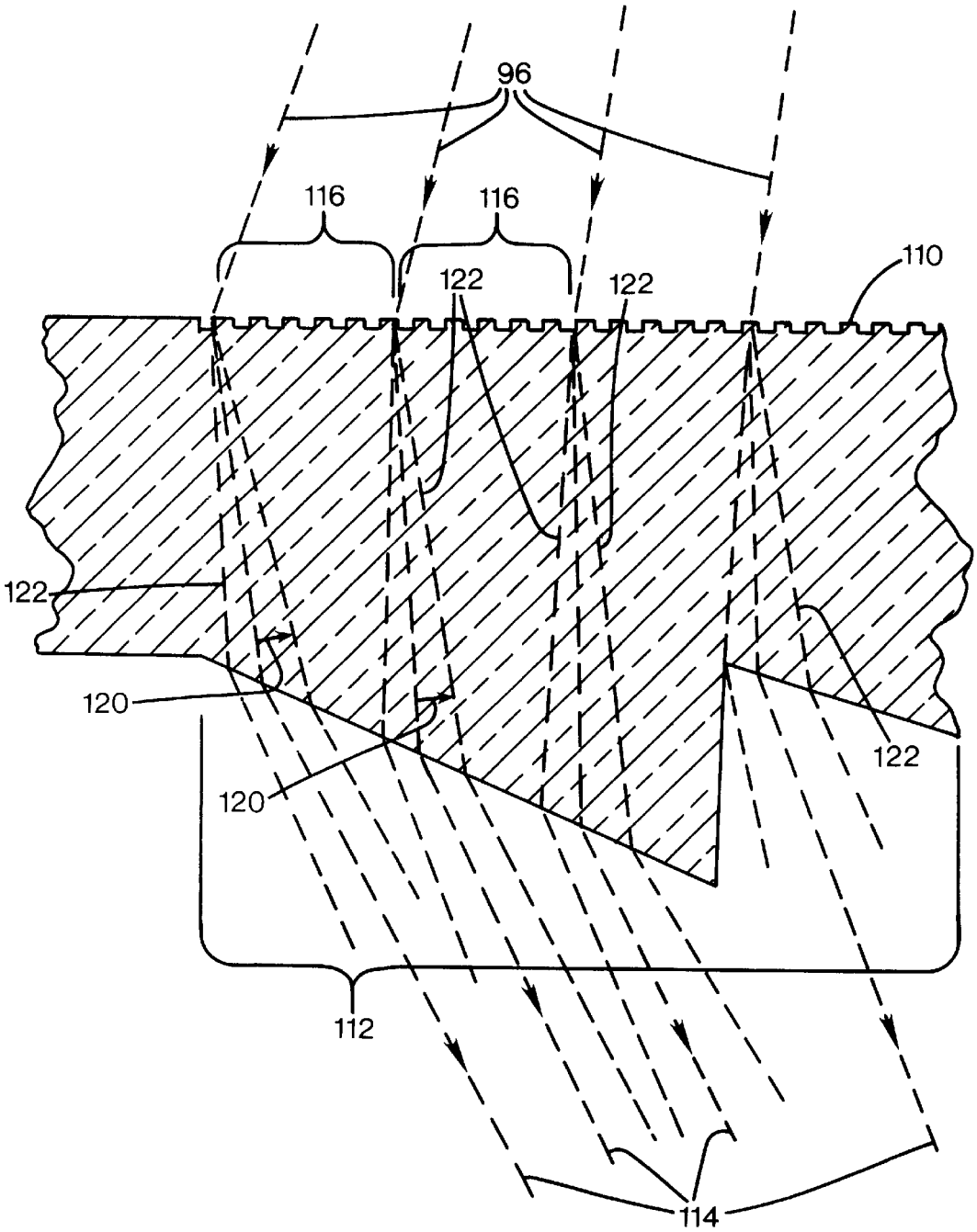
FIG. 5 is a greatly enlarged sectional view of the optical component of the module of FIG. 2.

As shown in FIG. 5, the rays 96 associated with the beams exiting the LED dome first encounter the diffractive surface, which is composed of a multitude of microscopic features 116. Each of these features may be assigned a different pitch, orientation, or relief amplitude. Thus, each feature of this surface may be programmed to diffract the small amount of radiation passing through it into an offset angle 120 from the undeviated direction 114. If the complete ray bundle encounters a multiplicity of these features 116, and they are statistically distributed in some predetermined fashion, a scrambling or diffusing effect may be achieved. By introducing an angular bias to the direction of diffraction of all the features 116, it is further possible to create a focusing and/or a deviating effect. Some diffractive elements may be "programmed" specifically to steer some rays more than others, and to direct rays from a subset of adjacent cells to spread across the entire selected area. This provides a "fly's eye" effect wherein each subset's nonuniform characteristics will tend to cancel out the nonuniformities of the other subsets. In this case, this technique is used to redistribute some of the light from the bright areas of the LED junction into the image of the wire bond obscuration.

In FIG. 4, the lens cluster 46 has a central portion 124 having a convex non-spherical lens element molded into the lower surface of the lens and centered on axis 56. This portion of the molded part might alternatively possess a powered upper surface, and a flat lower surface. Or, if necessary, both upper and lower surfaces could be powered and/or aspheric. The function of this portion of the optical cluster is to collect diffusely-scattered radiation from the media surface in the illuminated location 106, and to deliver a stigmatic, highly-corrected image of the illuminated information to the detector plane at 100. In special cases, one surface of the imaging element 126 may be made a diffractive surface, most likely the flat surface. If this is done, it is possible to modify this single optical portion so that it becomes achromatic, thus making it possible to co-focus images created by light from two LED illuminators having different wavelengths.

In the preferred embodiment, the lens includes a second lens portion 130 associated with LED lamp 42, which is selected to be a different color from lamp 40. Lens portion 130 may be a mirror image of portion 104, so the either LED 40 or LED 42 may be used. For determining color balance of multiple printed inks, the printer may compare results form each of the LED colors. In the preferred embodiment, the LED lamps emit at 450 nm and 571 nm. The diffractive optic molded lens may be fabricated using the technology of Digital Optics Company of Charlotte, N.C. The photo detector is part number TSL250, with an active area of 1.0 $mm^2$, available from Texas Instruments. Alternative models having a 0.5 or 0.26 $mm^2$ active area may be substituted in applications in which improved speed and reduced sensitivity are preferred.

In the preferred embodiment, the module has a height of 23 mm, a width of 20 mm, and a thickness of 10 mm. The optical cluster part or lens is spaced apart from the media plane by 10 mm, and the selected area 106 is 1.0 mm in diameter. While the entire selected area is viewed by the photodetector, the area illuminated by the LEDs may be slightly larger, about 1.5 mm in diameter.

In operation, the printer controller determines that an alignment and registration is required, such as when the printer is turned on, or when a pen has been replaced. The printer then prints two patterns of parallel bars of each color, both parallel to the scan axis and parallel to the feed axis. After printing, the carriage scans and the media is fed so that the optical sensor passes over each pattern, sending a variable voltage to the controller to indicate the presence of printing within the field of view. By this, the controller calculates the position of each pattern relative to the ideal position, and enacts a compensating correction for subsequent printing.

The scanning process involves activation of at least one of the LED lamps, whose light impinges upon the diffractive surface. The diffractive surface scrambles and converges the beam, partially diverting it toward the target area 106. The second surface of the lens cluster, the Fresnel surface, serves to complete the task of directing and focusing the light onto the selected region 106. The arrangement of illumination areas (104 and 130) in the lens cluster insures that purely specular energy reflected from the media will be directed toward the opposite illumination channel, not toward the imaging portion 124 of the cluster, to become unwanted stray radiation in the detector field. The scattered component of the energy reflected from 106 contains the information required for alignment and registration, and is partially captured by lens element 24, which concentrates it on the photodetector. The photodetector amplifies the electrical output of the photocell, and sends the resultant signal to the controller for analysis.

While the preferred embodiment is discussed in terms of using the sensor to determine alignment, it may also be used to determine color balance and optimized turn on energy. To adjust color balance, regions are printed with each color, or a composite of overlapping ink droplets may be printed. A gray patch printed using three color inks may be suitable. Using the expected reflectance of the different LED wavelengths from the printed colors, and comparing with measured reflectance, intensity of printing of particular colors may be adjusted. Color balance analysis may be conducted by sensing test patterns printed with different colors and drop volumes, to determine when a desired drop adjacency or overlap threshold is achieved for each color, depending on the printed droplet size. Related procedures may be used to analyze a printed test pattern to determine if any print head nozzles are not printing, or are misaimed.

To measure turn on energy, swaths of printing are made using different amounts of energy applied to the resistors of the print head. As the energy drops below a threshold, some nozzles will cease to function. The turn on energy is then set above this threshold by a limited amount, so that energy consumption is minimized without sacrificing print quality.

While the invention is described in terms of a preferred embodiment, the claims are not intended to be so limited.

We claim:

1. An optical sensor module for identifying characteristics of printed ink jet images on printing media residing in a media plane, the module comprising:

a chassis;

an illumination source connected to the chassis and spaced apart from the media plane;

a detector connected to the chassis and spaced apart from the media plane;

an integral optical element positioned between the media plane and the illumination source, and positioned between the media plane and the detector;

the optical element including a first portion having a first optical characteristic positioned on a first optical path between the illumination source and a selected region of the media plane; and the optical element including a second portion having a second optical characteristic different from the first optical characteristic and positioned on a second optical path between the illumination source and the selected region of the media plane.

2. The module of claim 1 wherein the optical element is formed of a single, uniform material.

3. The module of claim 1 wherein the optical element includes diffractive optics.

4. The module of claim 1 wherein the optical element is a planar element parallel to the media plane, and having optical features integrated into at least one of its major surfaces.

5. The module of claim 4 wherein the optical features include a fresnel lens, diffractive optics, and an aspheric lens.

6. The module of claim 1 wherein the first portion of the optical element includes diffractive optics and a fresnel element, such that light transmitted therethrough is directed to the selected region, focused to a limited spot, and diffracted to provide uniform illumination.

7. The module of claim 1 wherein the second portion of the optical element is positioned between the selected region of the media plane and the detector, and includes a focusing element having a focal length selected to focus at least a portion of light from the selected region onto the detector.

8. The module of claim 1 wherein the optical element is formed of a single piece of transparent plastic.

9. An ink jet printing system for printing ink jet images on printing media residing in a media plane, the system comprising:

a printer frame;

a media transport connected to the frame and operable to move a sheet of media within a media plane along a feed axis;

a carriage connected to the frame and movable along a scan axis adjacent to the media plane and perpendicular to the feed axis;

an ink jet print head mounted to the carriage;

an optical sensor module connected to the carriage, the sensor module comprising:

a chassis;

an illumination source connected to the chassis and spaced apart from the media plane;

a detector connected to the chassis and spaced apart from the media plane;

an integral optical element positioned between the media plane and the illumination source, and positioned between the image plane and the detector;

the optical element including a first portion having a first optical characteristic positioned on a first optical path between the illumination source and a selected region of the media plane; and the optical element including a second portion having a second optical characteristic different from the first optical characteristic and positioned on a second optical path between the illumination source and the selected region of the media plane.

10. The system of claim 9 wherein the optical element is formed of a single, uniform material.

11. The system of claim 9 wherein the optical element includes diffractive optics.

12. The system of claim 9 wherein the optical element is a planar element parallel to the media plane, and having optical features integrated into at least one of its major surfaces.

13. The system of claim 12 wherein the optical features include a fresnel lens, diffractive optics, and an aspheric lens.

14. The system of claim 9 wherein the first portion of the optical element includes diffractive optics and a fresnel element, such that light transmitted therethrough is directed to the selected region, focused to a limited spot, and diffracted to provide uniform illumination.

15. The system of claim 9 wherein the second portion of the optical element is positioned between the selected region of the media plane and the detector, and includes a focusing element having a focal length selected to focus at least a major portion of light from the selected region onto the detector.

16. A method of analyzing a printed image on a sheet of media, the method comprising:

generating a beam of light;

directing the beam of light to a selected region of the sheet;

focusing the beam to a limited area at the selected region;

scrambling the beam to provide uniform illumination of the selected region; and measuring light reflected from the selected region to determine characteristics of the printed image in the selected region.

17. The method of claim 16 wherein the steps of directing and focusing the beam includes transmitting the beam through a fresnel lens.

18. The method of claim 16 wherein the step of scrambling the beam includes deflecting different portions of the beam simultaneously in different directions.

19. The method of claim 16 wherein the step of scrambling the beam includes diffracting the beam.

20. The method of claim 16 wherein measuring light reflected from the selected region includes focusing light from the selected region onto a photodetector.

21. The method of claim 16 wherein the steps of directing, focusing, and scrambling the beam include transmitting the beam through a first portion of a single optical element, and wherein measuring light reflected from the selected region includes transmitting the light through a second portion of the optical element.

* * * * *

UNITED STATES PATENT AND TRADEMARK OFFICE

CERTIFICATE OF CORRECTION

PATENT NO. : 5,856,833

DATED : January 5, 1999

INVENTOR(S) : Elgee et al.

It is certified that error appears in the above-identified patent and that said Letters Patent is hereby corrected as shown below:

Column 7, (line 5), delete "image" and insert therefor --media--.

Signed and Sealed this

Twenty-ninth Day of June, 1999

*Attest:*

Q. TODD DICKINSON

*Attesting Officer*

*Acting Commissioner of Patents and Trademarks*